US005984672A

United States Patent [19]

Takigawa

[11] Patent Number: 5,984,672

[45] Date of Patent: Nov. 16, 1999

[54] CERAMIC FIBER BLOCK FOR LINING HIGH TEMPERATURE FURNACE

[75] Inventor: Seiichi Takigawa, Nishikasugai-Gun, Japan

[73] Assignee: Taki Industries Co., Ltd., Nishikasugai-Gun, Japan

[21] Appl. No.: 09/177,435

[22] Filed: Oct. 21, 1998

[30] Foreign Application Priority Data

Oct. 27, 1997 [JP] Japan ..... 9-294209
Sep. 7, 1998 [JP] Japan ..... 10-252144

[51] Int. Cl.[6] ..... F27D 1/08

[52] U.S. Cl. ..... 432/119; 373/75

[58] Field of Search ..... 432/103, 105, 432/110, 119; 373/75, 137, 155, 162, 164

[56] References Cited

U.S. PATENT DOCUMENTS

| | | | |
|---|---|---|---|
| 4,088,825 | 5/1978 | Carr | 373/130 |
| 4,154,975 | 5/1979 | Sauder | 13/25 |
| 4,569,659 | 2/1986 | Olsen et al. | 432/119 |
| 5,218,615 | 6/1993 | Wieland et al. | 373/75 |
| 5,280,495 | 1/1994 | Havas et al. | 373/155 |
| 5,624,256 | 4/1997 | Pfeiffer et al. | 432/252 |

*Primary Examiner*—Teresa Walberg
*Assistant Examiner*—Gregory A. Wilson
*Attorney, Agent, or Firm*—Klarquist Sparkman Campbell Leigh & Whinston, LLP

[57] ABSTRACT

A ceramic fiber block includes a welding stud disposed between two ceramic fiber layers centrally positioned in the ceramic fiber block. The welding stud includes a base stud which at its one end to be welded to a furnace wall and having a ceramic ferrule and at the other end formed with screw threads, an electrode rod having screw threads at its one end in the ceramic fiber block, and first and second nuts connecting the screw threaded ends of the base stud and electrode rod. The ceramic fiber block further includes an anchor bar between the centrally positioned ceramic fiber layers so as to perpendicularly intersect the welding stud, a pair of piercing rods piercing the whole ceramic fiber layers, a ferrule temporarily fixing agent such as an adhesive for temporarily fixing the ferrule to the end of the base stud, and a pair of platforms associated with the piercing rods for enabling hanger mounting studs to be provided at a predetermined interval, the hanger mounting studs provided with hangers for electric furnace heating elements. After the distal end of the base stud is melted and urged against the furnace wall through an electrode rod by means of a welding machine, so that the pair of piercing rods are urged toward the furnace wall through the anchor rod engaging the welding stud, thereby firmly fixing the ceramic fiber block in a prestressed condition to the furnace wall.

13 Claims, 15 Drawing Sheets

CERAMIC FIBER BLOCK FOR LINING HIGH TEMPERATURE FURNACE

BACKGROUND OF THE INVENTION

This invention relates to a ceramic fiber block for lining a high temperature furnace, which is composed of a plurality of rectangularly contoured laminated ceramic fiber layers successively bonded or bound together and includes a welding stud which is made of a metal to be welded to a furnace wall by electrical welding and disposed between two ceramic fiber layers centrally positioned in the ceramic fiber layers in the proximity of the rear end surfaces of the rectangularly contoured layers on the side of the relevant furnace wall and perpendicularly to the rear end surfaces, and a pair of piercing rods connected through an anchor bar to the welding stud and piercing the whole ceramic fiber layers.

With such a ceramic fiber block for lining a high temperature furnace, in general, as shown in FIG. 1 after the ceramic fiber block 1 has abutted against a furnace wall 2 made of a metal, an electrode rod 5 is extended from a guide sleeve 4 so as to contact a welding stud 6 by means of a stud welding machine 3 so that the welding stud 6 is connected to the furnace wall 2 by electrical welding. During such a welding operation the welding stud 6 is urged with its melted distal end against the furnace wall 2 so as to be welded to the furnace wall 2 and at the same time piercing rods 8 piercing a plurality of ceramic fiber layers are pulled toward the furnace wall 2 through curved anchor bars 7 wound about the piercing rods 8 to cause prestresses in the ceramic fiber block. As a result, the ceramic fiber block 1 is firmly fixed to the furnace wall 2. Thereafter, the electrode rod 5 is removed together with the guide sleeve 4 from the ceramic fiber block 1.

With the conventional ceramic fiber block for lining a high temperature furnace, in the case of an electric (resistance heating) furnace, after the ceramic fiber block has been fixed to a furnace wall, a pair of upper and lower ceramic rods 9 are embedded in the ceramic fiber block 1 in the vicinity of its front surface on the opposite side of the furnace wall so as to extend in parallel with piercing rods and then a plurality of S-shaped ceramic hangers 10 are forced into the ceramic fiber block 1 so as to be hanged on the ceramic rods 9 at a required predetermined interval in separate and troublesome operations as shown in FIG. 2. After these operations, corners of meandering or zigzag-shaped heating elements 12 are hanged on the exposed hook ends 10A of the S-shaped hangers 10 through ceramic washers 11, respectively.

In another conventional example of the ceramic fiber block, after base studs have been previously fixed to a furnace wall by welding, a ceramic fiber block is mounted on these base studs. Then, ceramic insulators are connected to the ceramic fiber block for finally arranging heating elements by hanging them on the ceramic insulators.

With such hitherto used ceramic fiber blocks for lining high temperature furnaces, however, in case of electric furnaces, the operation for mounting hangers for supporting heating elements is carried out in a separate step after the ceramic fiber blocks have been fixed to the furnace walls, with resulting low working efficiency.

SUMMARY OF THE INVENTION

It is an object of the invention to provide an improved ceramic fiber block for lining a high temperature furnace, which needs no separate step of mounting heating element hangers after the ceramic fiber block has been fixed to a furnace wall even when the high temperature furnace is an electric furnace and is effectively applicable to both the combustion furnace and the electric furnace.

In order to accomplish this object, the ceramic fiber block according to the invention comprises subject features in that said anchor bar is a straight anchor bar disposed between the interfaces of said two centrally positioned ceramic fiber layers and connected to said welding stud so as to be perpendicular thereto and spaced as a whole from said relevant furnace wall, said anchor bar being engaged with said piercing rods at its side facing toward the relevant furnace wall; that said welding stud comprises a base stud which at its one end facing toward the relevant furnace wall extends from said ceramic fiber block through a ceramic ferrule disposed in the rear end surface of said block and at the other end is formed with screw threads, said base stud engaging to the anchor bar so that said screw threaded portion of said base stud intersects said anchor bar, an electrode bar which at its one free end to be connected to an electrical welding machine extends from the front end surface of said ceramic fiber block facing away from said relevant furnace wall and at its other end to be arranged in said block is formed with screw threads, and nut means threadedly engaging the screw threads of said base stud and the screw threads of the inner end of said electrode bar, respectively, to connect these base stud and electrode bar and capable of disengaging from the screw threads of said electrode bar after the welding of said base stud to the relevant furnace wall to permit said electrode bar to be removed from said ceramic fiber block; that ferrule temporarily fixing means is provided for temporarily fixing said ferrule to the end of said base stud on the side of the relevant furnace wall; and that said piercing rods are constructed to be able to protrudingly provide, if required, through a pair of platform means, with hanger mounting studs at a predetermined interval for mounting and supporting respective hangers for extending heating elements for an electric furnace.

According to the subject features of the ceramic fiber block according to the invention for lining a high temperature furnace, the hanger mounting studs are associated with a pair of piercing rods through platform means, that is, the legs of the platform means adapted to be provided protrudingly with hanger mounting studs at a predetermined interval are engageable with the piercing rods, or the piercing rods themselves serve also as platform means adapted to be provided with hanger mounting studs at a predetermined interval as described above. Accordingly, for use in a combustion furnace, the ceramic fiber blocks may be finished without providing hanger mounting studs, while for use in an electric furnace, the ceramic fiber blocks may be finished by associating the hanger mounting studs with the piercing rods. Therefore, the ceramic fiber block according to the invention is applicable to both the types of furnaces.

In applying the ceramic fiber blocks according to the invention to an electric furnace, it is possible to protrudingly provide through the platform means a plurality of hanger mounting studs having a hanger in the form of a washer-nut arrangement at their exposed ends, respectively, at the interval of in the zigzag pitch of heating elements, thereby eliminating the need to mount hangers for a heating element in a separate step after fixation of the ceramic fiber blocks to the furnace walls and hence obtaining the effect of improvement in working efficiency.

The ceramic fiber blocks using the novel welding stud according to the invention for lining a high temperature furnace can be firmly fixed to the furnace walls in a higher prestressed condition, while it is advantageously possible to ascertain whether the welding stud has been appropriately welded to the furnace wall.

The invention will be more fully understood by referring to the following detailed specification and claims taken in connection with the appended drawings.

DESCRIPTION OF THE PREFERRED EMBODIMENTS

FIG. 3 illustrates a ceramic fiber block 20 for lining an electric furnace as a high temperature furnace, according to a preferred embodiment of the present invention. The ceramic fiber block 20 for lining the electric furnace as a high temperature furnace according to the invention comprises a plurality of laminated ceramic fiber layers 21 which are rectangularly contoured and successively bonded or bound one another, and a welding stud 22 arranged between interfaces of the two centrally positioned ceramic fiber layers 21C, which is in the vicinity of the rear edge of the rectangular ceramic fiber block 20 and extends substantially perpendicular to the rear edge, for the purpose of fixing the ceramic fiber block 20 to a furnace wall made of a metal by welding the tip end of the welding stud 22 to the metal furnace wall.

Figure 4:
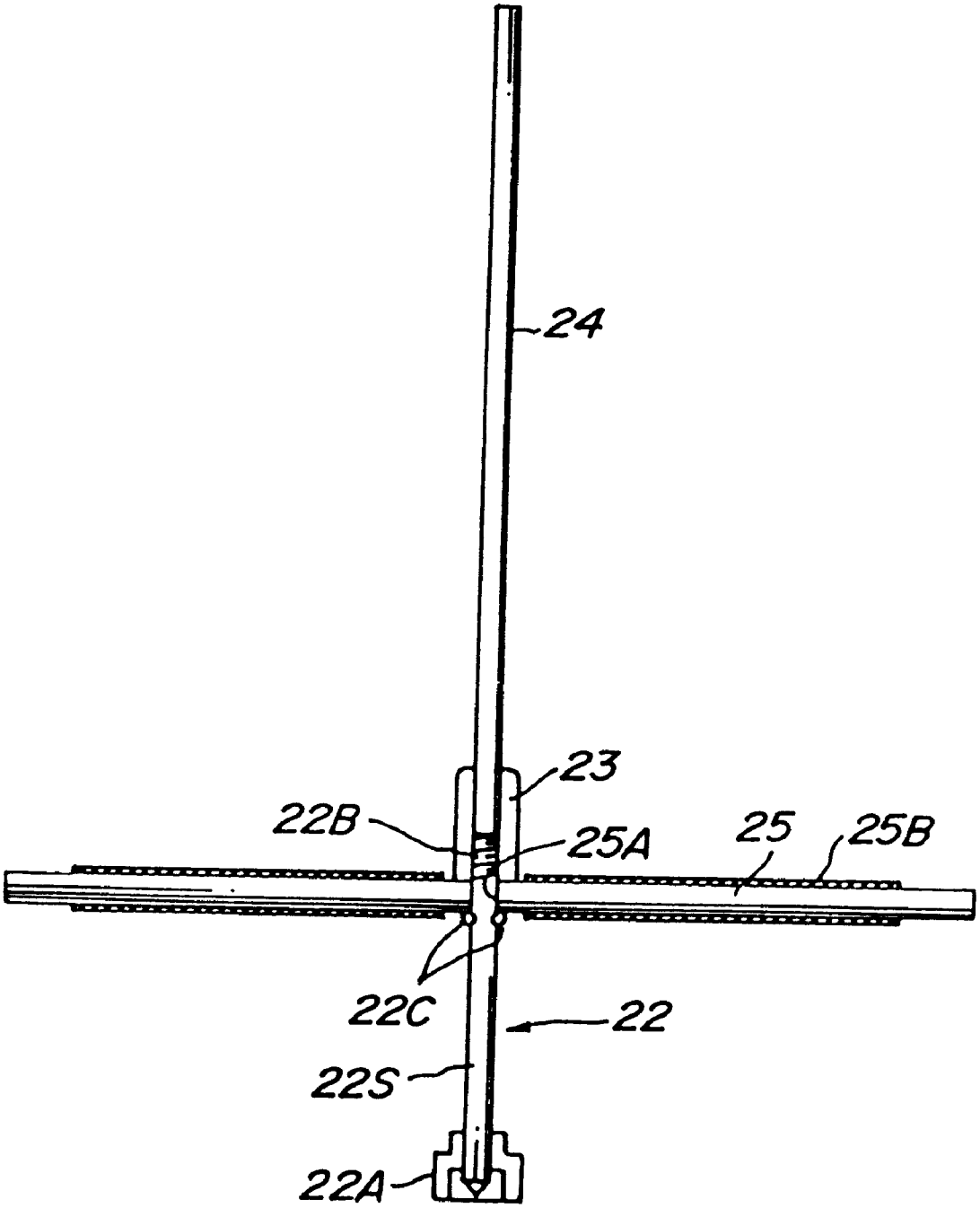
FIG. 4 is an explanatory view of the welding stud used in the ceramic fiber block shown in FIG. 3*a;*

In the preferred embodiment of the invention, as shown in FIG. 4, a base stud 22S of the welding stud 22 is provided on its one end adjacent to the relevant furnace wall with a ceramic ferrule 22A temporarily fixed to the end by means of an adhesive. The base stud 22S is formed in the other end with external threads 22B and further with a pair of stopper protrusions 22C extending radially outwardly and adjoining the bottom end of the external threads 22B. The threaded end of the base stud 22S is passed through a centrally formed opening 25A of an anchor bar 25, and a long size nut 23 longer than the threaded portion of the base stud 22S is then threaded on the threaded portion 22B extending beyond the opening 25A of the anchor bar 25 until the anchor bar 25 is securely held on the base stud 22S between the long size nut 23 and the stopper protrusions 22C abutting against the anchor bar 25. In this case, the welding stud 22 is composed of the base stud 22S, the long size nut 23, and an electrode rod 24 having one end abutting against and connected to the threaded end of the base stud 22S in the long size nut 23 and the other end extending beyond the front surface of the ceramic fiber block 20 facing away from the relevant furnace wall.

After the end of the base stud 22S of the welding stud 22 has been welded to the furnace wall, it is required to urge the fiber block under a prestressed condition against the furnace wall. In the embodiment shown in FIGS. 3 and 4, for this purpose, the straight anchor bar 25 is formed at its center with the opening 25A through which the threaded end of the base stud 22S extends, thereby fixing the anchor bar 25 between the long size nut 23 and the stopper protrusions 22C of the base stud as described above. Preferably, the anchor bar 25 is covered thereabout with tubular ceramic insulators 25B as shown in FIG. 4, or is coated with a ceramic insulating material, in order to achieve the electrical insulation during the electric welding.

Figure 3B:
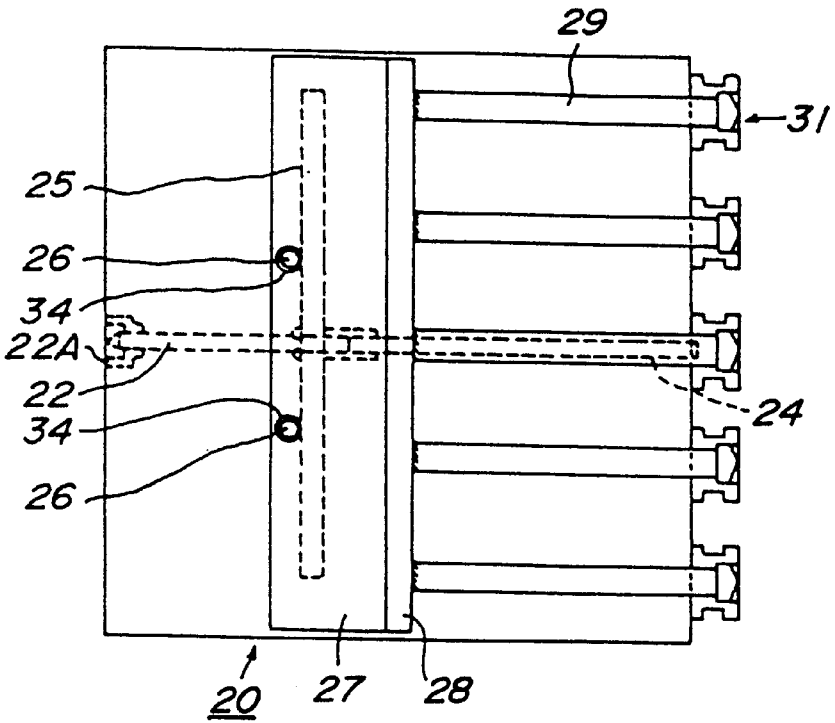
FIG. 3*b* is a plan view illustrating the plane on which the platform assembly of the ceramic fiber block shown in FIG. 3*a* is arranged.
Figure 3A:
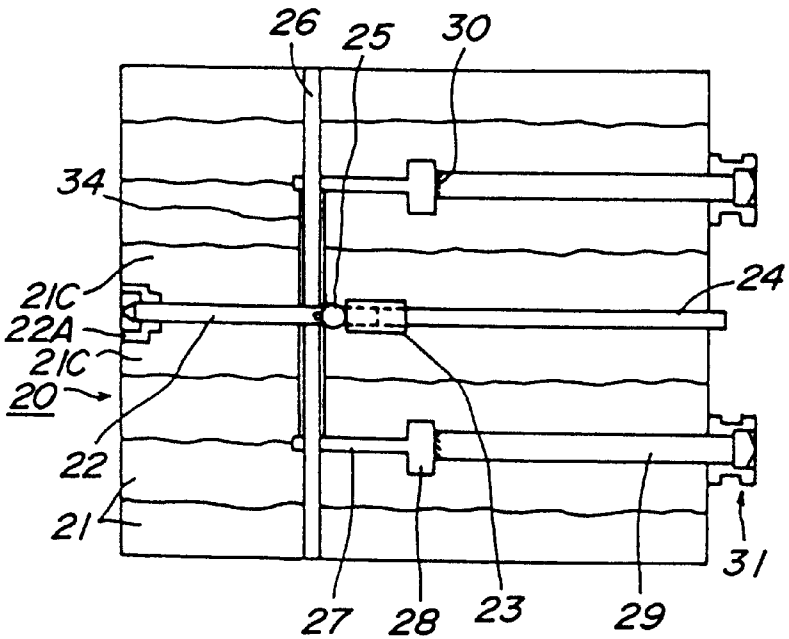
FIG. 3*a* is an explanatory longitudinal sectional view schematically illustrating the ceramic fiber block according to a preferred embodiment of the invention for lining a high temperature furnace, particularly to an electric furnace.

The ceramic fiber block 20 for lining an electric furnace as a high temperature furnace according to the invention is further provided with a pair of piercing rods 26 piercing all the laminated ceramic fiber layers 21 and 21C and extending perpendicularly to both the welding stud 22 and the anchor bar 25. In the illustrated embodiment, the pair of piercing rods 26 are located so as to engage that side face of the anchor bar 25 which faces the relevant furnace wall to which the end of the base stud 22S is to be welded. The pair of piercing rods 26 are arranged in symmetry with respect to the welding stud 22 (FIG. 3*b*).

Between interfaces of further pairs of ceramic fiber layers arranged above and below the centrally positioned layers 21C and in symmetry with respect to the layers 21C having the welding stud 22 and the anchor bar 25 provided therein, there are provided a pair of platforms 28 in parallel with the anchor bar 25 and each having a leg 27 engaging with the pair of piercing rods 26 and extending in parallel to the welding stud 22 and in the direction toward the end of the welding stud 22 to be welded. In the embodiment shown in FIG. 3, the platforms have a T-shaped cross-section. As apparent from FIG. 5, the piercing rods 26 preferably have stopper protrusions 26A at the locations corresponding to through-holes formed in the leg 27 of the lower platform 28.

Connected to the upper and lower platforms 28 at a predetermined interval or correspondingly to meandering or zigzag pitch of heating elements (FIG. 3*a*) are a plurality of hanger mounting studs 29 made of ceramic or metal for mounting hangers, for example, by welding at 30 in case of metallic studs, and the other ends of these studs 29 slightly extend from the front surface of the ceramic fiber block on the opposite side of the platforms 28 or facing away from relevant furnace wall. Hangers 31 as insulators are connected to the extended ends of these hanger mounting studs 29, respectively, for supporting the heating elements.

In arranging the ceramic fiber block 20 according to the invention in an electric furnace, the block 20 is brought into abutment against a furnace wall (not shown) and the welding stud 22 (base stud 22S) is then electrically welded to the furnace wall with the electrode rod 24 by means of a welding machine (not shown). In welding operation, while the end of the welding stud 22 is being melted in the ferrule 22A, the welding stud 22 is urged against the furnace wall through the electrode rod 24 by means of the welding machine to cause the welding stud 22 (base stud 22S) to slide relative to the ferrule 22A temporarily secured to the welding stud 22, thereby accomplishing the welding of the welding stud 22 (base stud 22S) to the furnace wall. Simultaneously, the piercing rods 26 are urged toward the furnace wall with the anchor bar 25 connected to the welding stud 22. As a result, the ceramic fiber block 20 is urged against the furnace wall as a whole so that it is securely fixed to the furnace wall in a prestressed condition. Thereafter, the electrode rod 24 is removed out of the ceramic fiber block 20. The space in the block where the electrode rod 24 has been located would be replaced by the expansion or restoration of the ceramic fiber with its inherent elasticity.

Figure 1:
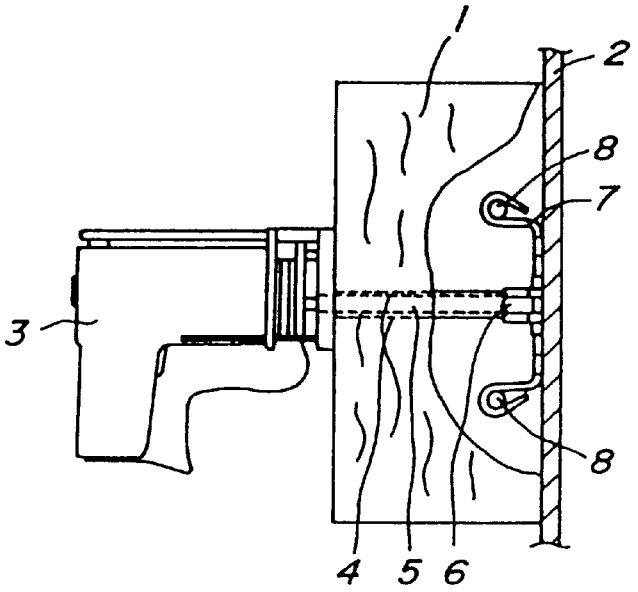
FIG 1 PRIOR ART
FIG. 1 is an explanatory view illustrating a ceramic fiber block of prior art for lining a high temperature furnace in the step of fixing the block to a furnace wall by means of a welding machine.
Figure 2:
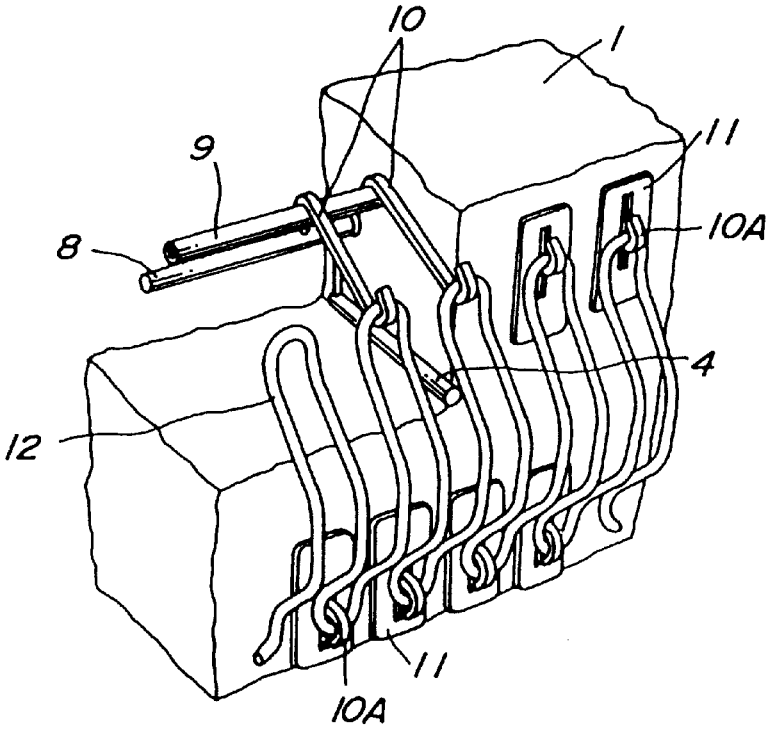
FIG 2 PRIOR ART
FIG. 2 is a partially removed perspective view illustrating another ceramic fiber block of prior art for lining a high temperature furnace in the step of hanging corners of zigzag-shaped heating elements on hanger hooks at exposed ends of hangers mounted on ceramic rods embedded in the ceramic fiber block.

After all the walls of the furnace have been lined with such ceramic fiber blocks 20, heating elements may be hanged with their meandering or zigzag-shaped portions on the hangers 31 (in a manner similar to that shown in FIG. 2) without requiring any hanger mounting operation for heating elements.

Although the platforms 28 are shown to have the T-shaped cross-section in the embodiment illustrated in FIG. 3, it will be apparent that they may have any other cross-section such as L-shaped or U-shaped cross-section without being limited to the shown cross-section. Moreover, the legs 27 need not be integral with the main bodies of the platforms, but may be separate members to be connected to their main bodies by welding.

Figure 6B:
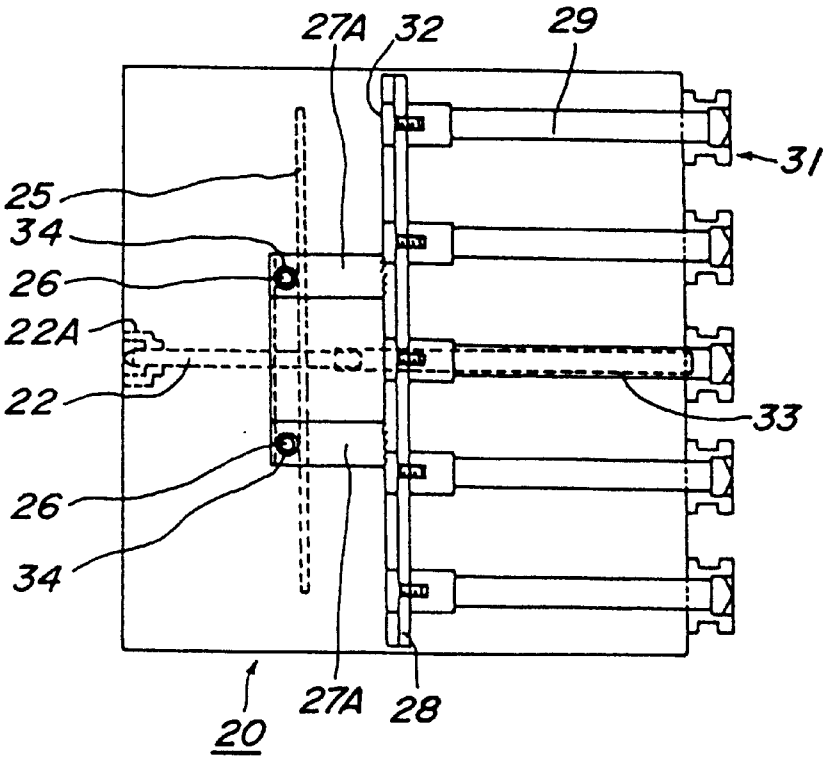
FIG. 6*b* is a plan view illustrating the plane on which the platform assembly of the ceramic fiber block shown in FIG. 6*a* is arranged.
Figure 6A:
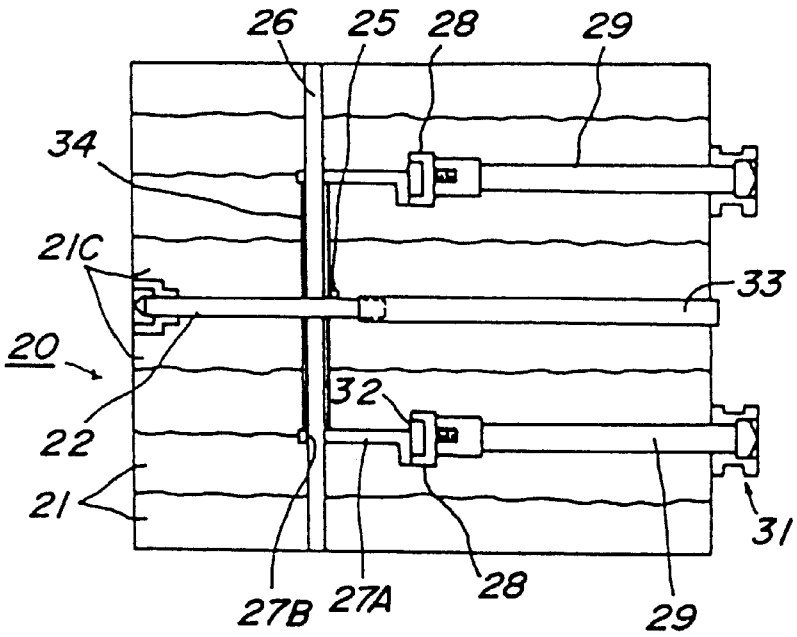
FIG. 6*a* is a schematic longitudinal sectional view for explaining the ceramic fiber block according to another preferred embodiment of the invention.

FIGS. 6*a* and 6*b* illustrate another embodiment of the invention, wherein each of main bodies of platforms 28 having a U-shaped cross-section comprises a pair of elongated legs 27A connected to the main body 28 by welding, and hanger mounting studs 29 made of ceramic are connected to the main body 28 by means of bolts 32. The hanger mounting studs 29 may be made of ceramic or metal. Each of legs 27A is formed with a through-hole 27B through which a piercing rod 26 extends. In this embodiment, moreover, an anchor bar 25 is connected to the welding stud 22 by welding, and there is provided a guide sleeve 33 for guiding an electrode rod (not shown). This guide sleeve 33 is removed from the ceramic fiber block after the ceramic fiber block has been fixed to a furnace wall by welding of the welding stud 22 to the furnace wall by means of a welding machine.

Figure 5:
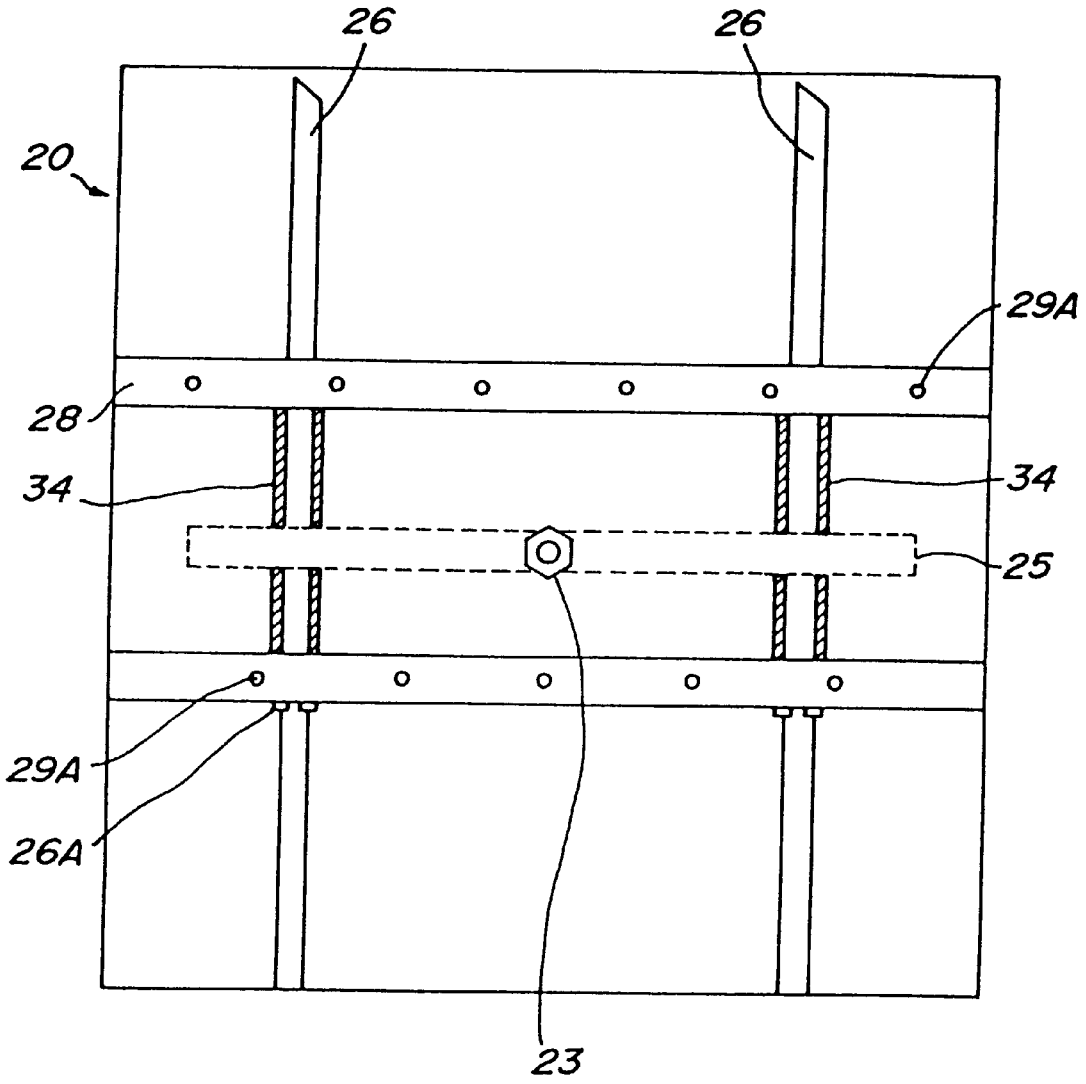
FIG. 5 is a longitudinal sectional view taken along a plane perpendicular to the sectional plane of FIG. 3*a*, illustrating the positional relations of the respective members.

In all the afore-mentioned embodiments in accordance with the invention, it is preferable to interpose spacers 34 between a pair of platforms 28 arranged above and below. In an advantageous embodiment, the spacers 34 are preferably sleeve-shaped spacers receiving therein the piercing rods 26 between the legs 27 or 27A of the platforms 28. Such spacers 34 serve to securely maintain the distance between the platforms 28 at a predetermined distance. FIG. 5 illustrates a further section perpendicular to that of FIG. 3*a*, which shows positional relations between the anchor bar 25, piercing rods 26, platforms 28, connecting points 29A for the hanger mounting studs 29, and spacers 34 in the preferred embodiment shown in FIG. 3.

Figure 7:
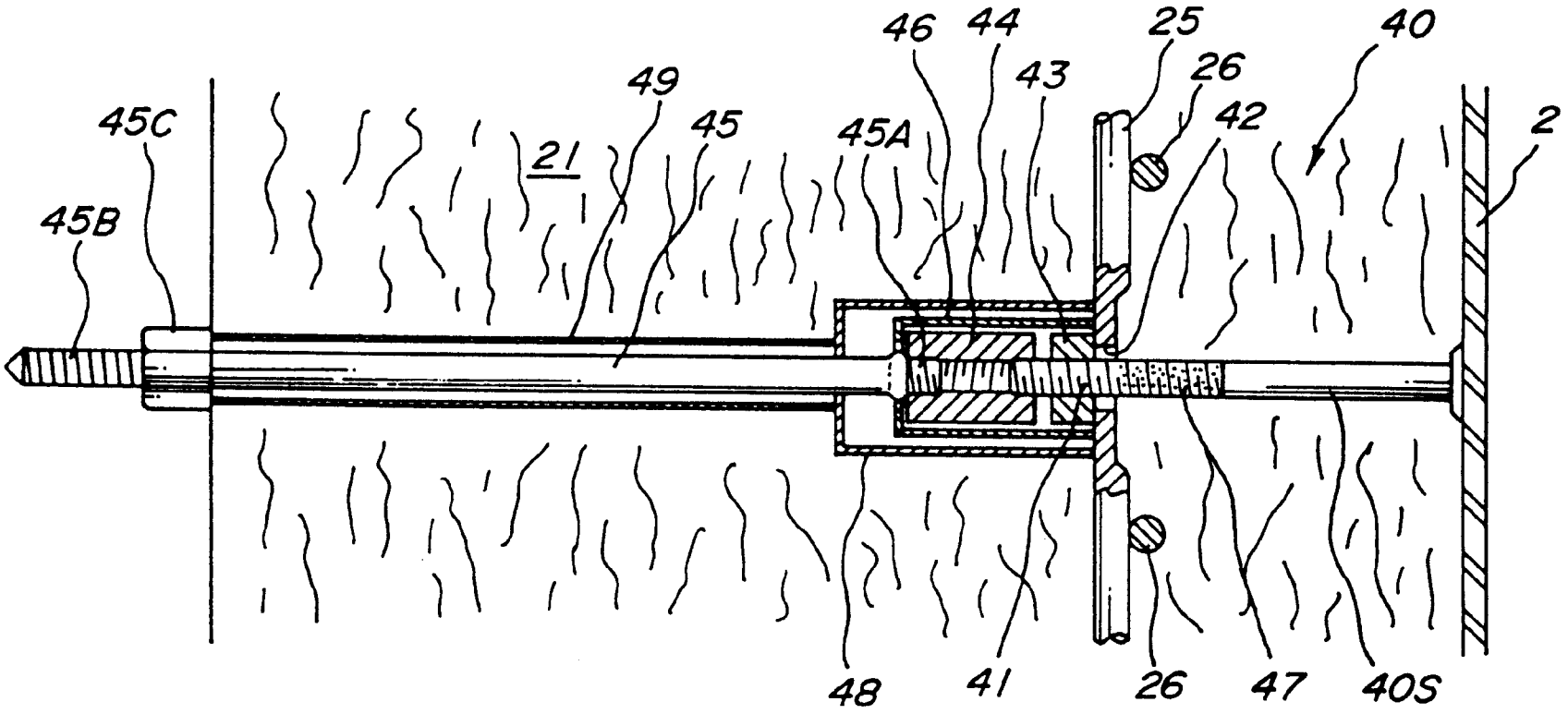
FIG. 7 is an explanatory view illustrating the ceramic fiber block according to a further embodiment of the invention.

FIG. 7 illustrates a further preferred embodiment of the welding stud according to the invention. As mentioned above, the end of the welding stud 22 shown in FIG. 4 is melted in the ferrule 22A temporarily fixed thereto with adhesive by means of the arc produced in a gap between the furnace wall and welding stud, while the welding stud 22 is moved relative to the ferrule so as to be urged against the furnace wall 2, thereby fixing the ceramic fiber block to the furnace wall 2 in the prestressed condition. The welding stud in the embodiment shown in FIG. 7 can compress the ceramic fiber block into a higher prestressed condition and hence to obtain a more rigid fixation of the ceramic fiber block to the furnace wall under such a prestressed condition and further can ascertain whether the welding has been properly effected.

The welding stud 40 according to the embodiment shown in FIG. 7 has a base stud 40S which is provided at one end adjacent to the furnace wall 2 with a ceramic ferrule temporarily fixed thereto with an adhesive and formed with screw threads 41 over a predetermined length from the other end, the screw threaded portion extending through an opening 42 centrally formed in an anchor bar 25.

A first nut 43 is threaded on the threaded portion 41 of the base stud 40S passing through the opening 42 of the anchor bar 25 to prevent the base stud 40S from removing from the anchor bar 25. The opening 42 of the anchor bar 25 in the embodiment shown in FIG. 7 is larger than the opening 25A of the anchor bar 25 in the embodiment shown in FIG. 4. A second nut, a long size nut 44 in this embodiment is threaded on the end of the threaded portion 41 of the base stud 40S in such a manner that the second nut 44 is spaced from the first nut 43 so as not to contact with each other.

An electrode rod 45 is formed on the side of the relevant furnace wall with screw threads 45A which are then threadedly engaged into the second long size nut 44 on the side opposite from the base stud 40S to connect the base stud 40 and the electrode rod 45, thereby forming the welding stud 40. In the initial state, the end of the electrode rod 45 facing toward the relevant furnace wall is spaced a predetermined distance from the distal end of the threaded portion of the base stud 40S in the second long size nut 44.

Moreover, the first nut 43 and the second long size nut 44 are held in a relatively spaced positional relationship in a retainer yoke 46 and fixed against rotation relative to each other. The retainer yoke 46 may be a U-shaped yoke or a hexagonal sleeve-shaped yoke having one closed end adapted to be engaged with the first and second nuts 43 and 44 and the other end formed with an opening through which the threaded portion 45A of the electrode rod 45 extends.

An anaerobic adhesive or tackiness agent 47 is coated on that portion of the screw threads 41 of the base stud 40S which does not threadedly engage the first and second nut 43 and 44 in the initial condition, that is, at least that portion of the screw threads 41 extending from the opening 42 of the anchor bar 25 toward the relevant furnace wall which threadedly engages the first nut 43 when being screwed thereinto.

The other end of the electrode rod 45 of the welding stud 40, facing away from the second nut 44 and extending out of the ceramic fiber block, is provided with a connecting portion 45B to be connected to a welding gun (not shown) and an operating portion, for example, a nut 45C for operating the welding stud 40.

In arranging such a ceramic fiber block including the thus assembled welding stud in the electric furnace, the base stud 40 is welded to the furnace wall 2 by means of the welding gun as described above. Thereafter, the operating portion (nut) 45C of the electrode rod 45 is rotated about its axis by means of a ratchet wrench or the like, so that long size nut 44, the retainer yoke 46 and the nut 43 are rotated about their axes in unison, as a result of which these members are bodily advanced along the threaded portion 41 of the base stud 40S toward the relevant furnace wall 2. Consequently, the nut 43 and the retainer yoke 46 would urge the anchor bar 25 and the piercing rods 26 engaged therewith toward the furnace wall 2 so that the whole ceramic fiber block would be more firmly urged against the furnace wall, thereby enabling the ceramic fiber block to be more rigidly fixed to the furnace wall 2 in a higher prestressed condition.

If the welding of the base stud 40S to the furnace wall 2 were insufficient, the base stud 40S would be rotated about its axis together with the rotating long size nut 44, retainer yoke 46 and nut 43, and hence the above clamping (compressing) effect could not be obtained. By the rotation of the base stud 40S together with the nuts 43 and 44 and the retainer yoke 46, it is also possible to ascertain whether the welding has been completely effected.

After the ceramic fiber block has been appropriately prestressed and sufficient welding has been ascertained, the nut 43 screwed onto the threaded portion coated thereon with the anaerobic adhesive or tackiness agent is restrained on the base stud 40S by the adhesive or tackiness agent. In general, such an anaerobic adhesive or tackiness agent does not exhibit its adhesive or tacking power until the nut has been screwed onto the threaded portion to the desired position to shut out the air.

Under the condition of the nut 43 restrained on the base stud 40S by means of the anaerobic adhesive or tackiness agent, the operating portion 45C of the electrode rod 45 is rotated about its axis in the direction to loosen it from the long size nut 44. During such a rotation of the electrode rod 45 about its axis, the nut 43, the retainer yoke 46 and the long size nut 44 would not rotate about their axes relative to the base stud 40S, only the electrode rod 45 is rotated about its axis so that it leaves the long size nut 44. The electrode rod 45 can be removed from the ceramic fiber block in this manner.

In order to facilitate the rotation of the electrode rod 45 and the retainer yoke 46 in the ceramic fiber block, preferably, the retainer yoke 46 is surrounded by a cylindrical sleeve 48 made of paper formed with an opening through which the electrode rod 45 passes. In order to facilitate the rotation of the electrode rod 45 for loosening it from the long size nut 44, furthermore, that portion of the electrode rod 45 which extends between the ceramic fiber layers 21 outside the cylindrical sleeve 48 is preferably covered with a straw-shaped tube 49.

Figure 8:
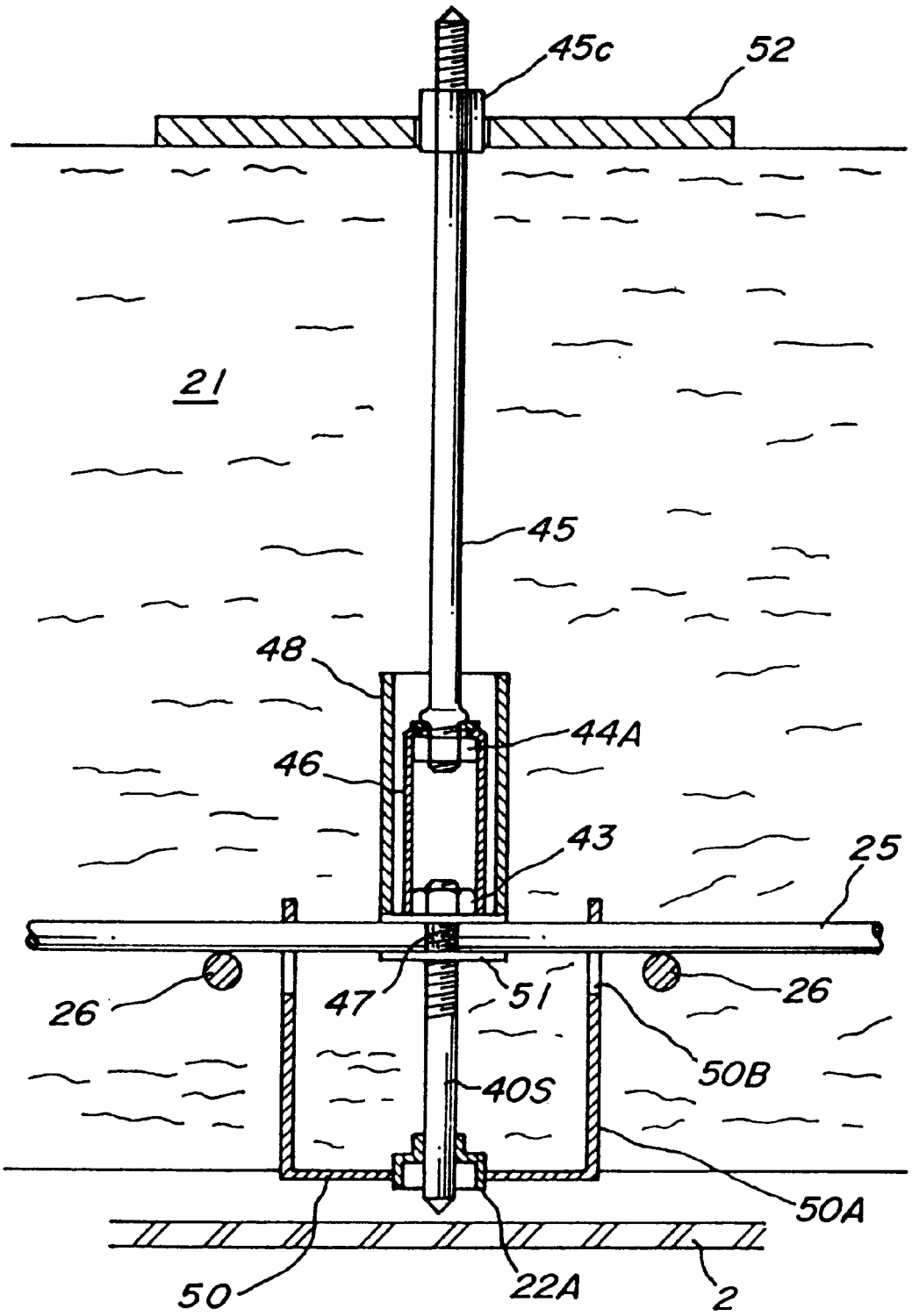
FIG. 8 is a partial sectional side view illustrating the ceramic fiber block having the modified ferrule support means and welding stud according to another embodiment of the invention.
Figure 10A:
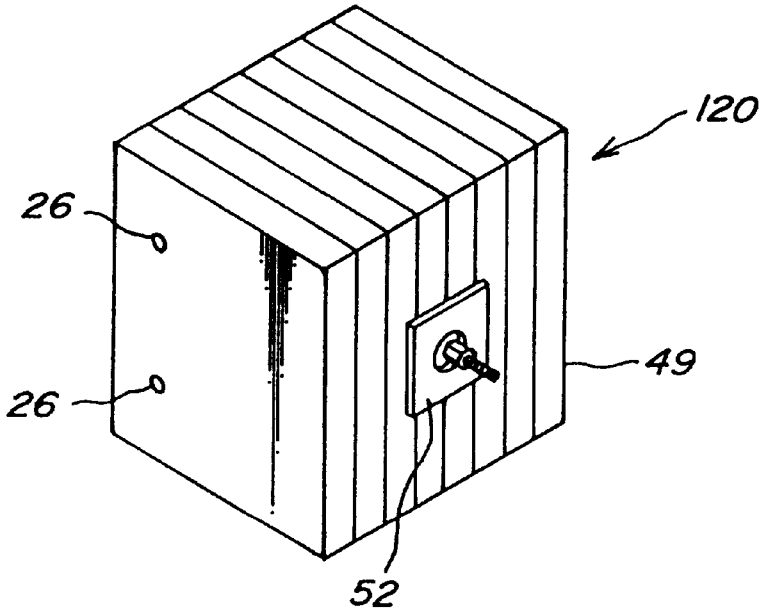
FIG. 10*a* is a perspective view of the ceramic fiber block according to the invention to be applied to a combustion furnace.
Figure 10B:
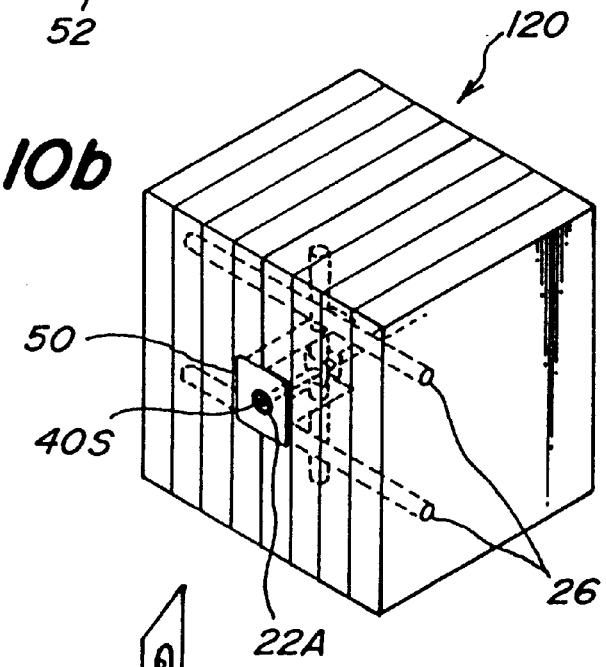
FIG. 10*b* is a perspective view of the ceramic fiber block shown in FIG. 10*a*, viewed from its rear side.
Figure 10C:
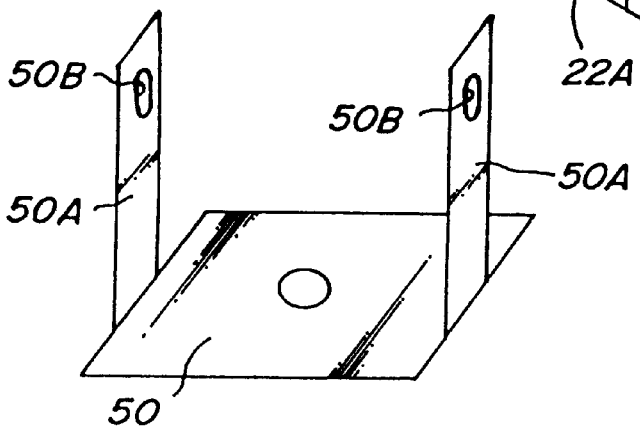
FIG. 10*c* is a perspective view illustrating the ferrule support yoke used in the ceramic fiber block shown in FIG. 10*a;*
Figure 11:
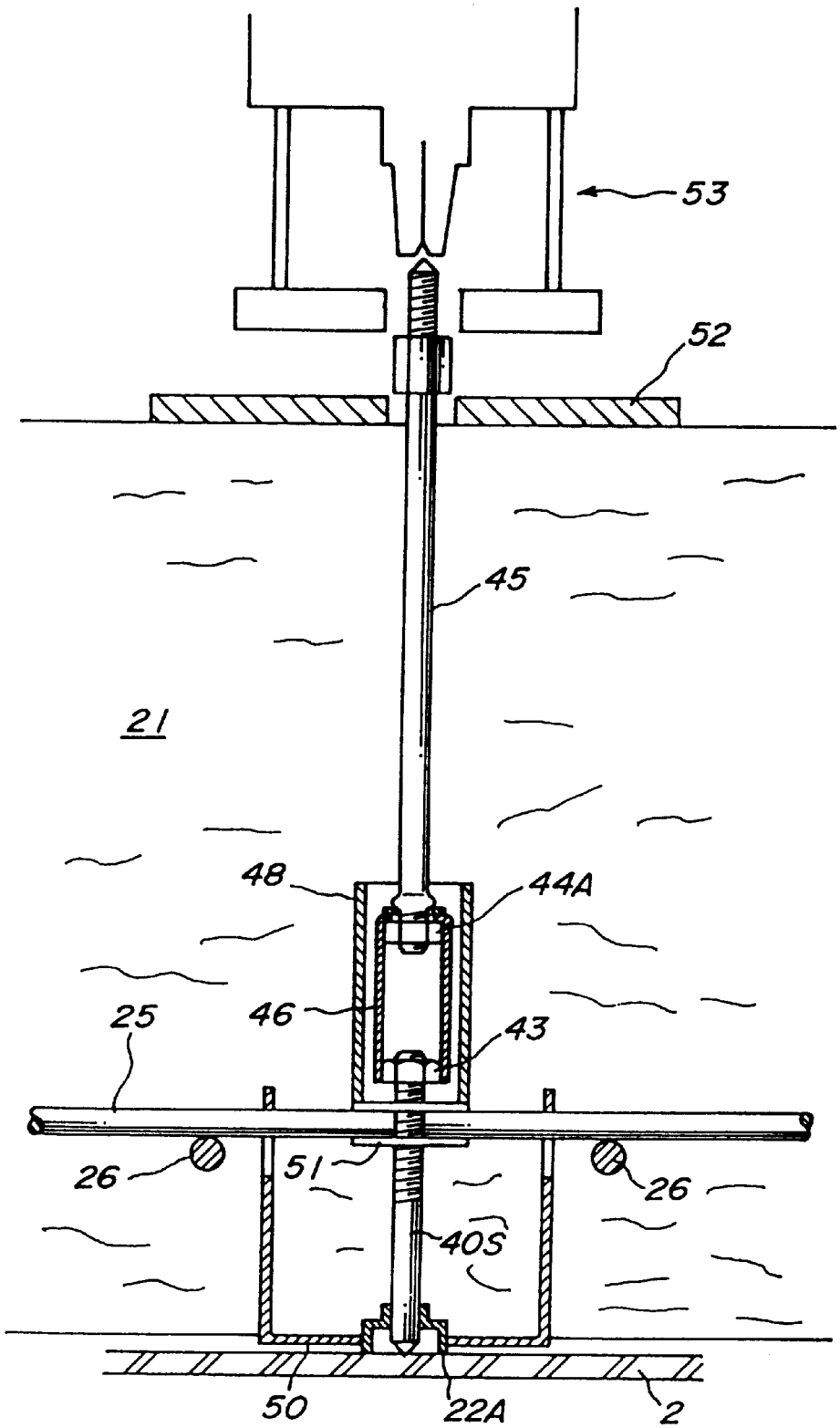
FIG. 11 is a partial side view of the ceramic fiber block shown in FIG. 8 in the step in which a welding machine has been set.

FIG. 8 illustrates a further embodiment of the ceramic fiber block according to the invention for lining a combustion furnace as a high temperature furnace. In the shown embodiment, for the purpose of temporarily holding a ferrule, there is provided a ferrule support yoke 50 made of an extinguishable material for holding a ferrule 22A and having a pair of arms 50A engaging an anchor bar 25 for slidably guiding it in the axial direction of the base stud 40S keeping the parallel relationship to the furnace wall (FIG. 10C). For this purpose, each of the arms 50A of the U-shaped ferrule support yoke 50 is further formed with an elongated slot 50B for slidably guiding the anchor bar 25 in the axial direction of the base stud 40S keeping the parallel relationship to the furnace wall.

Figure 9:
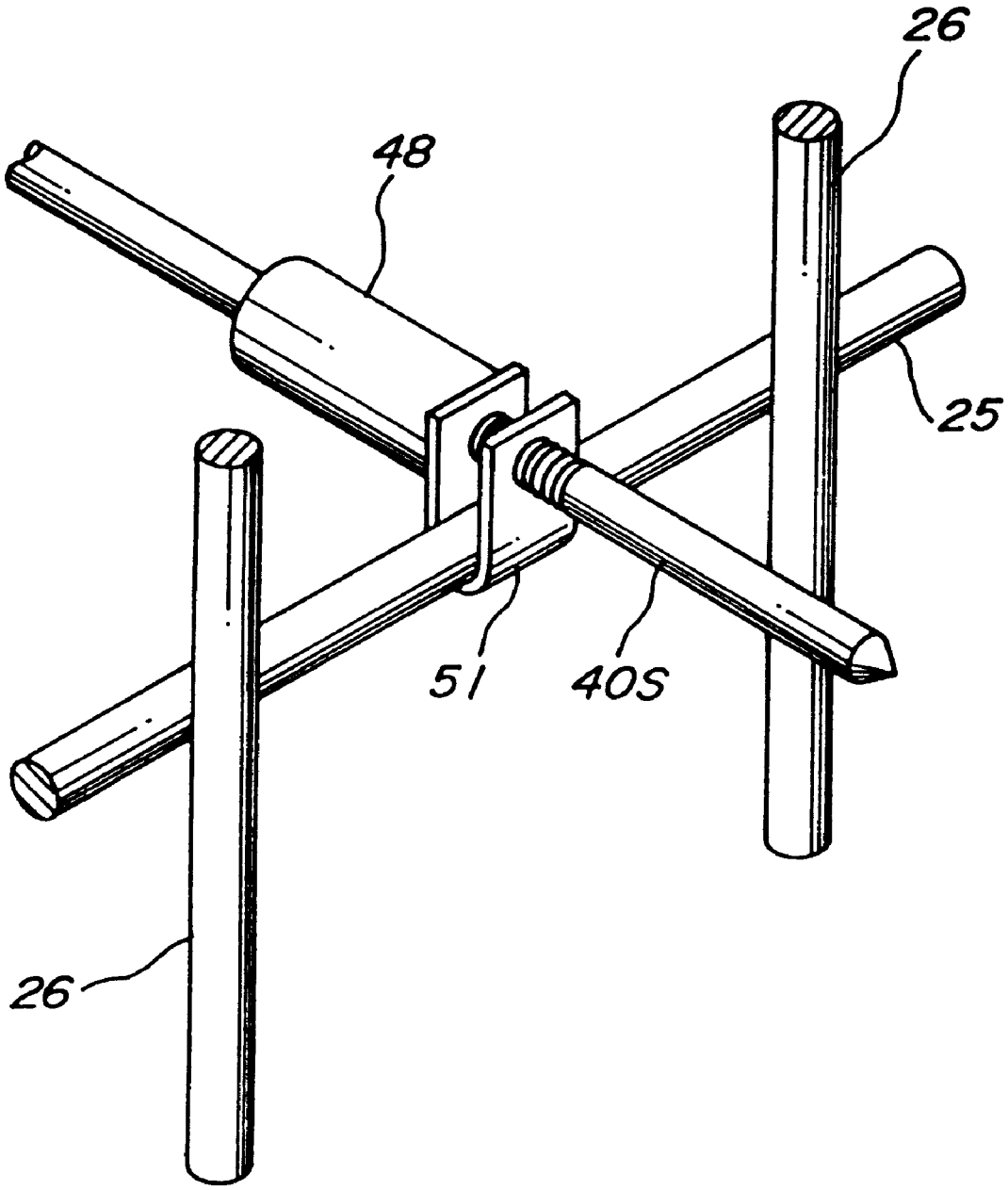
FIG. 9 is a partial sectional fragmental perspective view illustrating a modification of connection of the welding stud and anchor bar using a U-shaped member.

In the embodiment shown in FIG. 8, instead of the opening formed in the anchor bar 25 for engaging it with the base stud 40S, there is provided a U-shaped member 51 which receives the anchor bar 25 therein and whose legs are formed with aligned apertures through which the base stud 40S passes as shown in FIG. 9. Moreover, an electrode rod 45 is provided with a second nut 44A which is a conventional nut, but not a long size nut 44 as in the embodiment shown in FIG. 7. Employing the U-shaped member 51 according to this embodiment eliminates the need to provide an opening in the anchor bar 25 through which the base stud 40S passes. This is very advantageous because of elimination of reduction in mechanical strength of the anchor bar 25 due to the flat portion of the anchor bar 25 which is required for forming the opening.

In the embodiment shown in FIG. 8, moreover, a hardboard 52, which is extinguishable by burning, is arranged around the electrode rod 45 and the operating portion (nut) 45C at the front surface of the ceramic fiber block facing away from the relevant furnace wall as shown in FIGS. **10*a* and 10*b*, without providing hanger mounting studs through platform means. The ceramic fiber block 120 according to the invention for lining the combustion furnace is then finished by tightly wrapped (to compress the fiber block) by a stretchable and self-bonding film (not shown) which is flammable without producing any organic toxic gases. However, parts of the ferrule 22A, the operating portion (nut) 45C and the electrode rod 45** may be exposed to outside of the wrapped block.

In all the embodiment of the invention, when the ceramic fiber block is used for lining an electric furnace as a high temperature furnace, the block is finished by wrapping it by a film as described above under the condition of the block having piercing rods 26 provided with hanger mounting studs through platform means.

Figure 12:
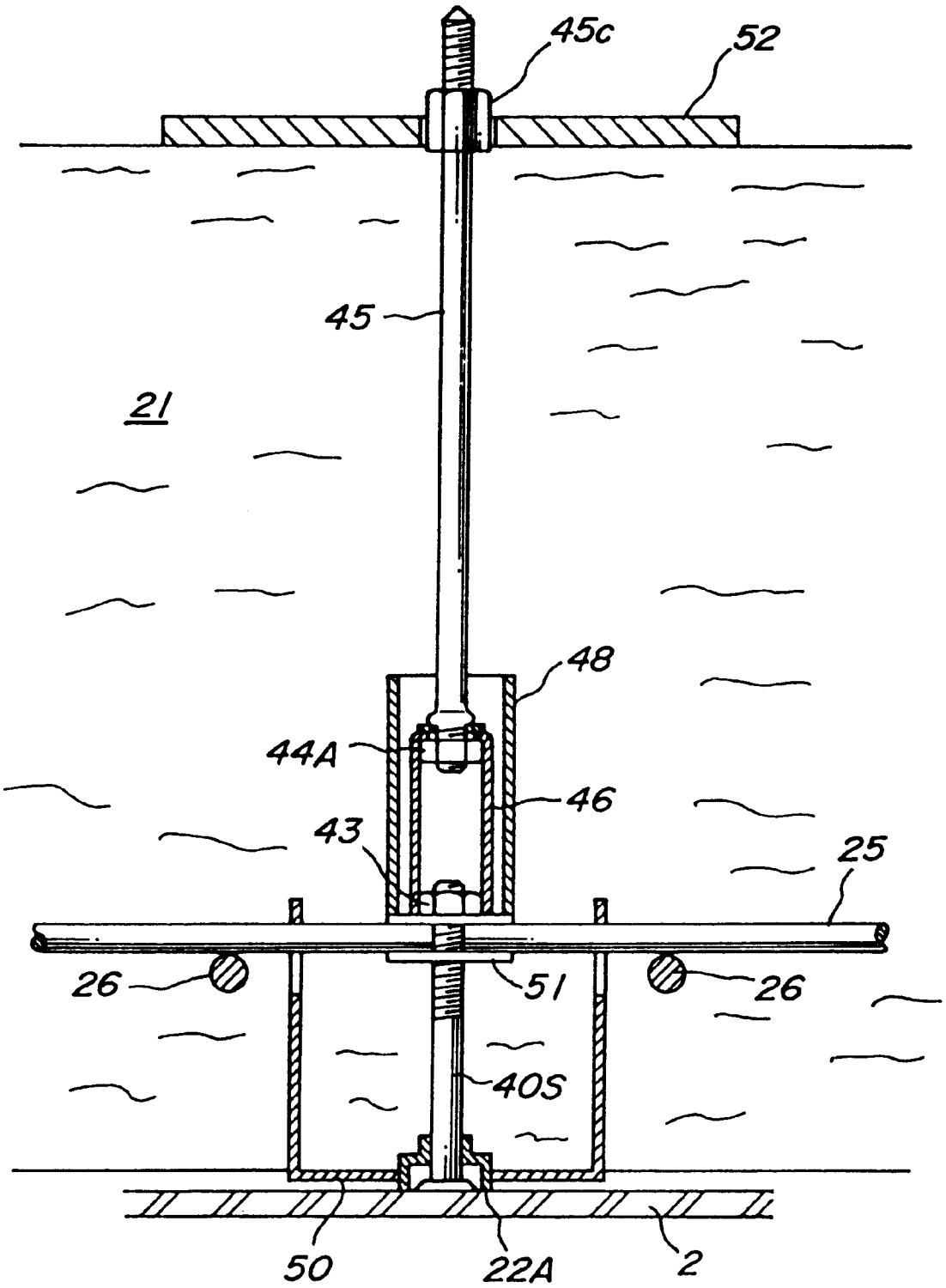
FIG. 12 is a partial side view of the ceramic fiber block shown in FIG. 8 in the state that the welding has been finished.
Figure 13:
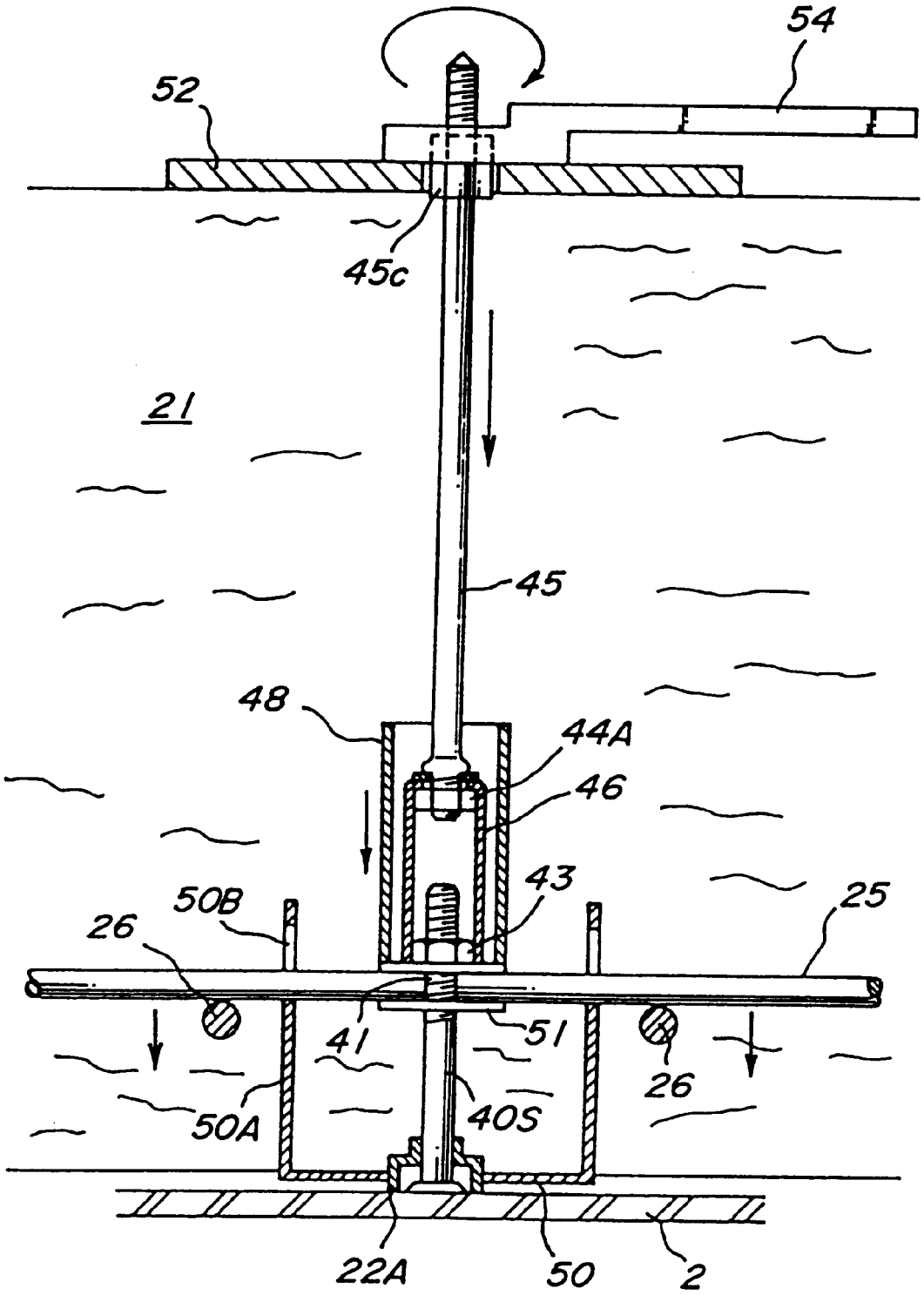
FIG. 13 is a partial side view of the ceramic fiber block shown in FIG. 8 in the step in which, after completion of the welding, the whole ceramic fiber block is being compressed into a high prestressed condition toward the furnace wall, as a result of rotating the nut means through the electrode rod, causing the anchor bar to press the piercing rods.
Figure 14:
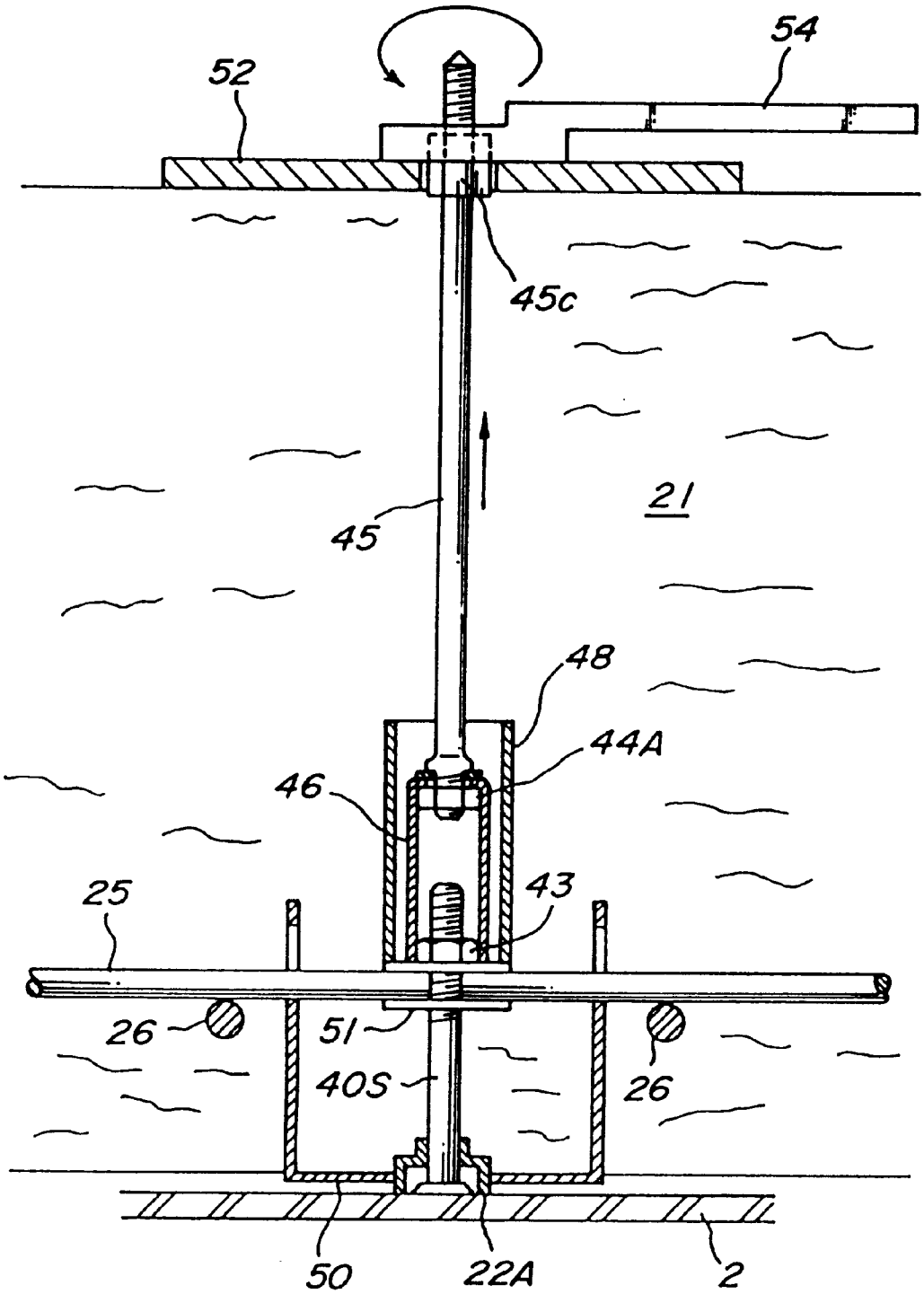
FIG. 14 is a partial side view of the ceramic fiber block shown in FIG. 8 in the step in which after the block has been compressed in the high prestressed condition to the furnace wall, the electrode rod is being removed from the block.
Figure 15:
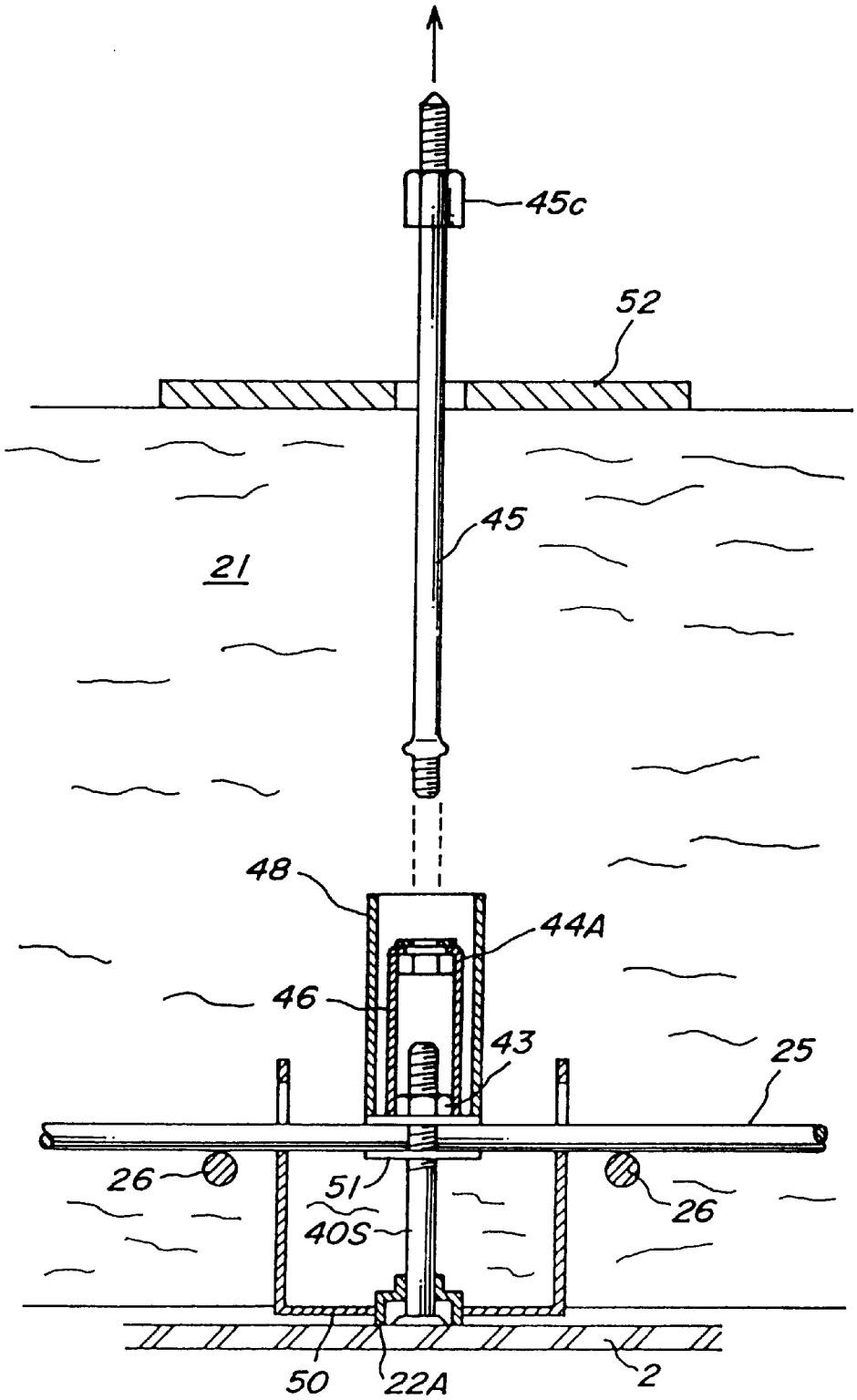
FIG. 15 is a partial side view of the ceramic fiber block shown in FIG. 8 in the state that the electrode rod has been removed from the block compressed in the high prestressed condition to the furnace wall.

FIGS. 11 to 15 illustrate respective steps for lining the wall of a combustion furnace with the ceramic fiber block according to the embodiment shown in FIG. 8. First, a welding machine 53 is set (FIG. 11) and the end of the base stud 40S is welded to the furnace wall 2 (FIG. 12). The operating portion (nut) 45C of the electrode rod 45 is then rotated about its axis by means of a ratchet wrench 54 to rotate the second nut 44A, the retainer yoke 46 and the nut 43 about their axes in unison so that the nut 43 is screwed onto the threaded portion 41 of the base stud 40S to cause these united members 44A, 46 and 43 to advance along the threaded portion of the base stud 40S toward the furnace wall 2. As a result, the nut 43 and the retainer yoke 46 will urge the U-shaped member 51, the anchor bar 25 embraced by the U-shaped member 51 and the piercing rods 26 engaging the anchor bar 25 toward the furnace wall 2 (the anchor bar movable along the elongated slots50B formed in the arms 50A of the U-shaped ferrule support yoke 50), so that the whole ceramic fiber block is pressed against the furnace wall 2, thereby firmly fixing the ceramic fiber block to the furnace wall under a higher prestressed condition (FIG. 13). After the nut 43 has been restrained on the base stud by the anaerobic adhesive or tackiness agent in the meantime, the operating portion (nut) 45C of the electrode rod 45 is rotated about its axis in the direction opposite to the first mentioned tightening direction so as to be loosened (FIG. 14), thereby finally removing the electrode rod 45 from the ceramic fiber block (FIG. 15). In the case of the ceramic fiber block with the hanger mounting studs associated with the piercing rods through the platform means, the lining operation may be performed in the same manner as described above.

When an electric furnace or combustion furnace lined with the ceramic fiber blocks 20, or 120 is operated, the ferrule support yoke 50 and the hardboard 52 will be extinguished and also the stretchable and self-bonding wrap film will be extinguished without producing any organic toxic gases. As a result, the ceramic fiber block, which has been compressed, would be allowed to expand, so that adjacent blocks would be brought into intimate contact with one another in a prestressed condition, with the result that these ceramic fiber blocks firmly cover the walls of the furnace.

Figure 16A:
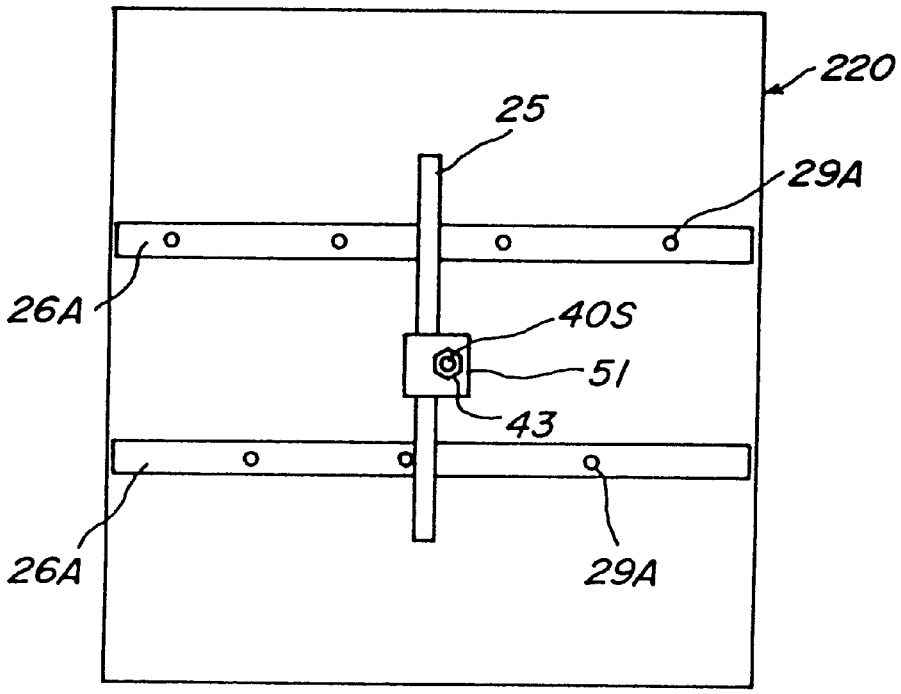
FIG. 16*a* is a plan view of a modification of the ceramic fiber block according to the invention whose piercing rods serve also as platform means for providing hanger mounting studs, illustrating the plane on which the piercing rods and other members are arranged.
Figure 16B:
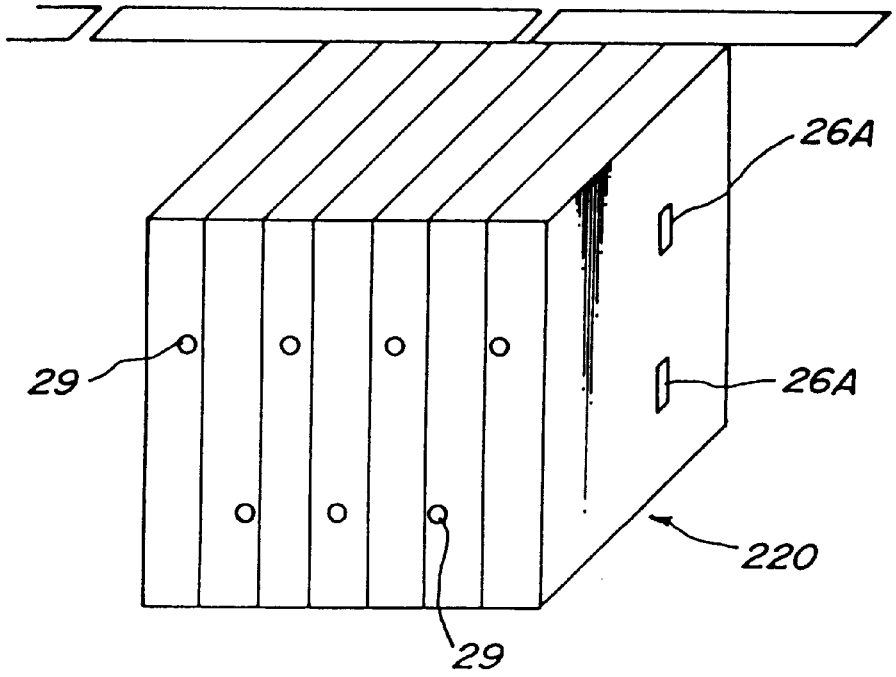
FIG. 16*b* is a perspective view of the ceramic fiber block shown in FIG. 16*a*, viewed from the side of the hanger mounting studs.

FIG. 16*a* illustrates a particular embodiment of the invention, in which platform means are constructed by a pair of piercing rods themselves which perpendicularly intersect an anchor bar 25 and are in the form of a flat rod 26A enabling hanger mounting studs to be provided thereon at a predetermined interval. FIG. 16*b* is a perspective view illustrating a ceramic fiber block 220 provided with such piercing rods 26A serving also as platform means for lining an electric furnace according to a further embodiment of the invention.

According to the ceramic fiber block of the invention for lining a high temperature furnace, even when the high temperature furnace is an electric furnace, as the piercing rods make it possible to provide hanger mounting studs through platform means, the ceramic fiber block provided with heating element hangers can simply be prepared for the electric furnace. Therefore, there is no need to mount heating element hangers in a separate step after the fixation of the ceramic fiber block to the furnace wall and it is only necessary to fix the ceramic fiber block to the furnace wall. According to the invention, regardless whether the platform means are present or not, after the distal end of the welding stud is melted and urged against the furnace wall through an electrode rod by means of a welding machine, so that the pair of piercing rods are urged toward the furnace wall through the straight anchor rod engaging the welding stud, thereby firmly fixing the ceramic fiber block in a prestressed condition to the furnace wall.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A ceramic fiber block for lining a high temperature furnace, said block composed of a plurality of rectangularly contoured laminated ceramic fiber layers successively bonded or bound together, and including a welding stud made of a metal to be welded to a furnace wall by electrical welding, said welding stud disposed between two ceramic fiber layers centrally positioned in said ceramic fiber layers in the vicinity of the rear end surfaces of said rectangularly contoured layers facing toward the relevant furnace wall and perpendicularly to said rear end surfaces, and a pair of piercing rods connected through an anchor bar to said welding stud and piercing the whole ceramic fiber layers, wherein said anchor bar is a straight anchor bar disposed between the interfaces of said two centrally positioned ceramic fiber layers and connected to said welding stud so as to be perpendicular thereto and spaced as a whole from said relevant furnace wall, said anchor bar being engaged with said piercing rods at its side facing toward the relevant furnace wall, wherein said welding stud comprises a base stud which at one end facing toward the relevant furnace wall extends from said ceramic fiber block through a ceramic ferrule disposed in the rear end surface of said block and at its other end is formed with screw threads, said base stud engaging to the anchor bar so that said screw threaded portion of said base stud intersects said anchor bar, an electrode bar which at its one free end to be connected to an electrical welding machine extends from the front end surface of said ceramic fiber block facing away from said relevant furnace wall and at its other end to be arranged in said block is formed with screw threads, and nut means threadedly engaging the screw threads of said base stud and the screw threads of the inner end of said electrode bar, respectively, to connect these base stud and electrode bar and capable of disengaging from the screw threads of said electrode bar after the welding of said base stud to the relevant furnace wall to permit said electrode bar to be removed from said ceramic fiber block, wherein ferrule temporarily fixing means is provided for temporarily fixing said ferrule to the end of said base stud on the side of the relevant furnace wall, and wherein said piercing rods are constructed to be able to provide, if required, through a pair of platform means, with hanger mounting studs at a predetermined interval for mounting and supporting respective hangers for extending heating elements for an electric furnace.

2. The ceramic fiber block for lining a high temperature furnace as set forth in claim 1, wherein said ferrule temporarily fixing means is an adhesive.

3. The ceramic fiber block for lining a high temperature furnace as set forth in claim 1, wherein said ferrule temporarily fixing means is constructed by a ferrule support yoke made of an extinguishable material which is able to hold said ferrule and has a pair of legs which engage said anchor bar to slidably guide said anchor bar in the axial direction of said base stud, keeping substantially in parallel with the relevant furnace wall.

4. The ceramic fiber block for lining a high temperature furnace as set forth in any one of claims 1 to 3, wherein said platform means are constructed by said pair of piercing rods themselves in the form of flat rods capable of providing thereon hanger mounting studs at a predetermined interval and perpendicularly intersecting said anchor bar.

5. The ceramic fiber block for lining a high temperature furnace as set forth in any one of claims 1 to 3, wherein said platform means are constructed by a pair of platforms arranged in parallel with said anchor bar and between interfaces of further pairs of ceramic fiber layers located above and below said centrally positioned ceramic fiber layers and in symmetry with respect to the centrally positioned layers, respectively, said pair of platforms having respective legs capable of engaging said pair of piercing rods and provided with a plurality of hanger mounting studs at a predetermined interval.

6. The ceramic fiber block for lining a high temperature furnace as set forth in claim 5, wherein each of said platforms comprises a platform body and said leg formed integral therewith.

7. The ceramic fiber block for lining a high temperature furnace as set forth in any one of claims 4 to 6, wherein sleeve-shaped spacers are provided which are substantially perpendicular to said platform means and mounted about said piercing rods or anchor bar between said platform means.

8. The ceramic fiber block for lining a high temperature furnace as set forth in any one of claims 1 to 7, wherein said nut means comprises, a first nut threadedly engaging said threaded portion of the base stud which has extended through said anchor bar, a second nut arranged spaced apart from said first nut, said inner end of said electrode rod being threadedly engaged in said second nut from the side facing away from said base stud, a nut retainer for holding said first and second nuts in a spaced relationship and preventing the relative rotation between said first and second nuts, and an anaerobic adhesive or tackiness agent coated on that portion of the threaded portion of said base stud which does not threadedly engage said first nut in the initial condition and at least threadedly engages said first nut when being threaded thereinto.

9. The ceramic fiber block for lining a high temperature furnace as set forth in claim 8, wherein said second nut is a long size nut and able to threadedly engage distal end of the threaded portion of said base stud.

10. The ceramic fiber block for lining a high temperature furnace as set forth in claim 8 or 9, wherein said nut retainer is constructed by a hexagonal sleeve.

11. The ceramic fiber block for lining a high temperature furnace as set forth in any one of claims 8 to 10, wherein said nut retainer is housed in a cylindrical sleeve made of paper.

12. The ceramic fiber block for lining a high temperature furnace as set forth in claim 11, wherein that portion of said electrode rod which extends between said ceramic fiber layers at least outside said cylindrical sleeve is housed in a straw-shaped tube.

13. The ceramic fiber block for lining a high temperature furnace as set forth in any one of claims 1 to 12, wherein said ceramic fiber block comprises a stretchable and self-bonding film which is flammable without producing any organic toxic gases and has at least one opening permitting at least one of the electrode rod, the ferrule and the base stud projecting from the front or rear surface of the ceramic fiber block to extend through said opening, said ceramic fiber block being tightly wrapped in a highly compressed condition by said film.

* * * * *